US007794019B2

(12) United States Patent
Hoberman

(10) Patent No.: US 7,794,019 B2
(45) Date of Patent: Sep. 14, 2010

(54) FOLDING STRUCTURES MADE OF THICK HINGED SHEETS

(76) Inventor: Charles Hoberman, 472 Greenwich St., New York, NY (US) 10013

( * ) Notice: Subject to any disclaimer, the term of this patent is extended or adjusted under 35 U.S.C. 154(b) by 690 days.

(21) Appl. No.: 11/483,328

(22) Filed: Jul. 7, 2006

(65) Prior Publication Data

US 2007/0012348 A1 Jan. 18, 2007

Related U.S. Application Data

(60) Provisional application No. 60/697,416, filed on Jul. 8, 2005.

(51) Int. Cl.
*A47C 7/00* (2006.01)

(52) U.S. Cl. ..... 297/440.12; 297/16.1; 108/165

(58) Field of Classification Search ..... 297/440.12, 297/16.1, 16.2; 211/199, 198; 108/166, 108/165, 115; 160/135; 428/182; 244/172.6
See application file for complete search history.

(56) References Cited

U.S. PATENT DOCUMENTS 1,592,146 A * 7/1926 Miller et al. ..... 5/722
2,693,847 A * 11/1954 Kablotsky ..... 267/145
4,293,965 A * 10/1981 Hrubec ..... 5/705
4,780,344 A 10/1988 Hoberman
4,807,766 A * 2/1989 Compagnucci ..... 211/198
4,942,700 A 7/1990 Hoberman
4,981,732 A * 1/1991 Hoberman ..... 428/12
5,008,140 A * 4/1991 Schmertz ..... 428/179
5,024,031 A 6/1991 Hoberman
5,081,728 A * 1/1992 Skinner ..... 5/727
5,234,727 A 8/1993 Hoberman
5,899,842 A 5/1999 Di Pilla
5,947,885 A * 9/1999 Paterson ..... 493/451
6,010,096 A * 1/2000 Baghdasarian ..... 244/172.6
6,082,056 A 7/2000 Hoberman
6,125,771 A 10/2000 Platt et al.
6,190,231 B1 2/2001 Hoberman
6,219,974 B1 * 4/2001 Hoberman ..... 52/81.5
6,394,541 B1 5/2002 Wegner
6,739,098 B2 5/2004 Hoberman
6,834,465 B2 12/2004 Hoberman
6,935,997 B2 * 8/2005 Kling ..... 493/356
2002/0112413 A1 8/2002 Hoberman
2004/0134157 A1 7/2004 Hoberman
2005/0097832 A1 5/2005 Hoberman
2005/0098947 A1 5/2005 Hoberman et al.

* cited by examiner

*Primary Examiner*—David Dunn
*Assistant Examiner*—Erika Garrett
(74) *Attorney, Agent, or Firm*—Gottlieb, Rackman & Reisman P.C.

(57) ABSTRACT

A linkage comprised of at least four links is provided. Each of the links has a polygonal profile with each link having at least two hinged axes that do not intersect one another. Each link is connected to at least two other links by the non-intersecting axes such that the linkage can smoothly transform from an extended surface into a compact bundle. The linkage can be constructed into the form of a foldable chair, a foldable table or a foldable wall.

20 Claims, 10 Drawing Sheets

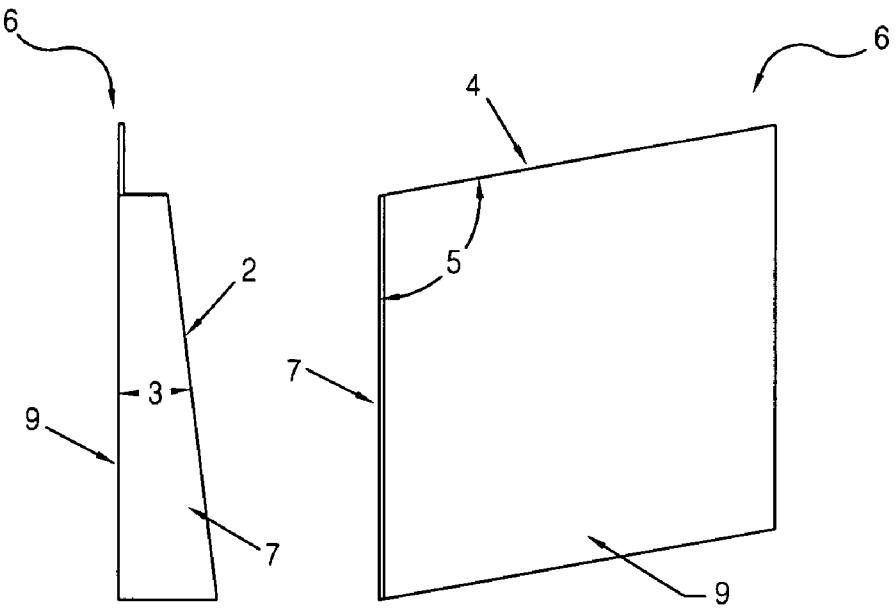
FIG.3
FIG.2
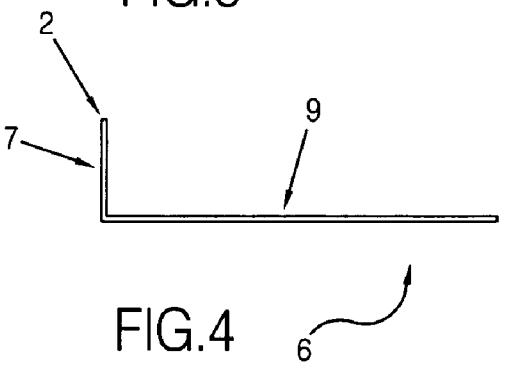
FIG.4
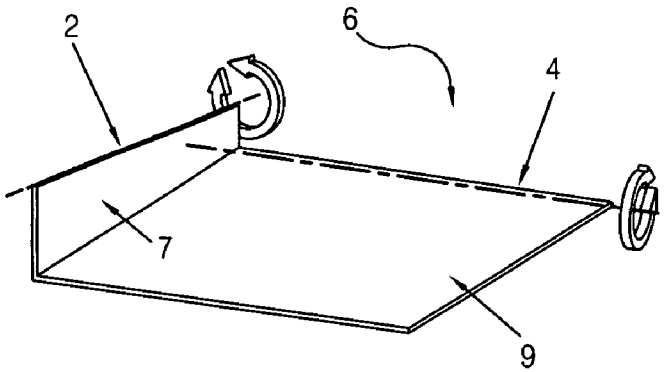
FIG.1

200
202
204
206
209
212
213
214
215
216
222
224
226

FOLDING STRUCTURES MADE OF THICK HINGED SHEETS

BACKGROUND OF THE INVENTION

This application claims priority of provisional patent application No. 60,697,416, filed Jul. 8, 2005.

There are numerous inventions and discoveries relating to methods for folding sheets of material. Some of these methods relate to forming a three dimensional shape from a two dimensional sheet. Other methods take this a step further in that they provide for a folding and unfolding process that is smooth and continuous. One might term this second type "reversible origami".

A critical inventive component of such methods are various tiling patterns that may be scored into sheets of material. One of the most famous of these patterns is "Miura-Ori" ("ori" being the Japanese term for folding)—named after its inventor Professor Koryo Miura, from Tokyo University. This particular pattern, consisting of a grid of parallelograms, allows for a sheet of material to be compacted down in two dimensions.

Also known in the art are various patterns including those disclosed in my own U.S. Pat. Nos. 5,234,727 and 4,981,732. These disclosures relate to novel shapes that may be developed from a sheet of material, which may then be smoothly folded down to compact bundles.

Such methods have numerous uses for foldable structures and products, including sails, tents, and novel packaging.

In general, these methods require sheets of material whose thickness is very minor when compared to their planar extent. To the degree that the sheet has a thickness of any significance, it is generally required that its material have flexibility and compressibility in order to allow folding to occur.

However, this requirement for flexibility results in significant limitations with regards to the provision of foldable forms requiring a high degree of structural rigidity. Applications that require rigidity include any large-scale structures, as well as products such as foldable furniture, boxes, or foldable dividers.

Accordingly, it would be desirable to provide foldable forms with a high degree of structural rigidity in which the sheets thereof can have significant thickness.

SUMMARY OF THE INVENTION

Generally speaking, in accordance with the invention, a method whereby a sheet of material of significant thickness and rigidity may be provided with a network of hinges that allow the assembly to smoothly fold down to a compact bundle, and then instantly open into an extended structurally rigid shape, is provided.

A critical innovation of the disclosed method is in the spatial arrangement of the hinges or "fold-lines". In the earlier inventions referred to above, all hinges lie within the basic plane of the sheet. As the sheet folds in such inventions, the hinges take on a three-dimensional arrangement, whereby neighboring hinges have intersecting axes.

In the present invention, provision is made for hinges that lie in different planes, whereby their axes do not intersect and thus are offset relative to each other and to the basic plane of the structure. Such offsets allow for a thick sheet of material to fold down into a cubic bundle.

Further disclosed herein are various applications for this folding method, which include folding chairs, tables and self-supporting space dividers.

It will therefore be shown that objects and advantages of the invention will be found in the following description.

BRIEF DESCRIPTION OF THE DRAWINGS

FIG. 1 is a perspective view of a first link used in the inventive assembly;

FIG. 2 is an elevational view of the link of FIG. 1;

FIG. 3 is a plan view of the link of FIG. 1;

FIG. 4 is a second elevational view of the link of FIG. 1;

DETAILED DESCRIPTION OF THE PREFERRED EMBODIMENT

Figure 5:
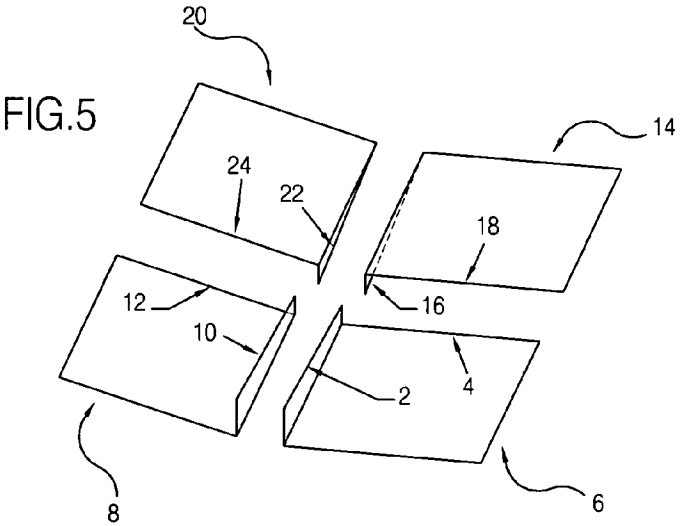
FIG. 5 is an exploded view of a first embodiment of the inventive link assembly.

FIG. 1 shows a perspective view of a link 6 that is comprised of two planes 7 and 9. Plane 7 has an axis 2 lying along one edge. Plane 9 has an axis 4 lying along one edge. Axes 2 and 4 do not intersect.

FIG. 2 shows link 6 in elevation view. Axis 2 forms an angle 3 relative to plane 9.

FIG. 3 shows link 6 in plan view. Axis 4 forms an angle 5 relative to plane 7.

FIG. 4 shows a second elevation view of link 6.

FIG. 5 shows an exploded view of assembly 30 which is comprised of four links 6, 8, 14 and 20. Link 6 has two non-intersecting axes 2 and 4. Similarly, links 8, 14 and 20 have two non-intersecting axes each, respectively 10 and 12, 16 and 18, 22 and 24.

Figure 6:
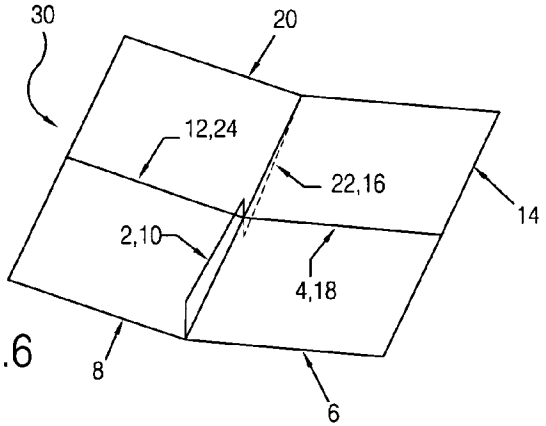
FIG. 6 is a perspective view of the inventive link assembly of FIG. 4.

FIG. 6 shows a perspective view of assembly 30. Link 6 has been attached to link 8 by pivotally joining axes 2 and 10. Likewise, link 8 has been attached to link 20 by pivotally joining axes 12 and 24. In a similar manner, axes 22 and 16 join links 20 and 14, while axes 18 and 4 join links 14 and 6.

Axes 2,10 lies in a common plane with axes 16,22 and therefore these axes intersect each other. Likewise, axes 12,24 and 4,18 intersect each other. However, axes 2,10 and 16,22 do not intersect axes 12,24 nor do they intersect axes 4,18.

Figure 7:
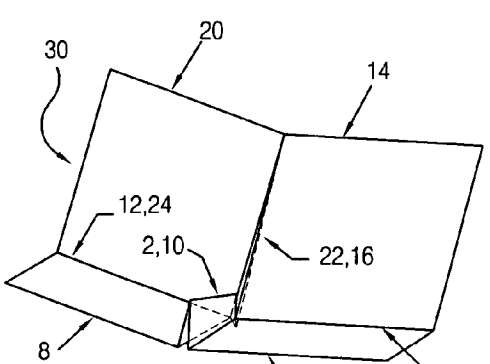
FIG. 7 is a perspective view of the link assembly of FIG. 5 in a partially folded condition.

FIG. 7 shows assembly 30 in a partially folded position.

Figure 8:
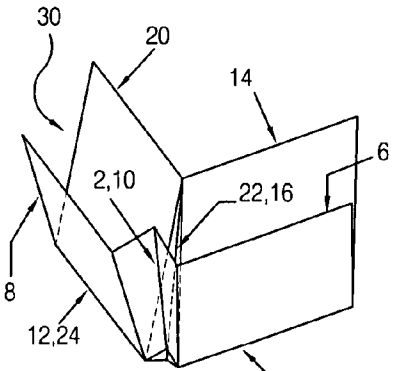
FIG. 8 is a perspective view of the link assembly of FIG. 5 in a further folded condition.

FIG. 8 shows assembly 30 in a further folded position. The relationships of the respective axes with regards to whether they intersect is unchanged from that which is described in FIG. 5.

Figure 9:
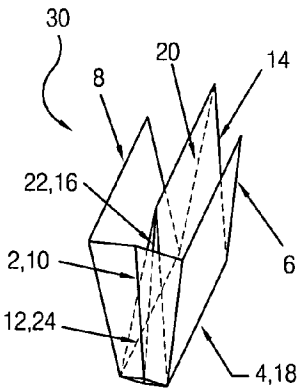
FIG. 9 is a perspective view of the link assembly of FIG. 5 in a fully folded condition.

FIG. 9 shows assembly 30 in a fully folded position, wherein the four links 6,8,14 and 20 form a volumetric stack. The intersecting relationships between the axes remain unchanged.

Figure 10:
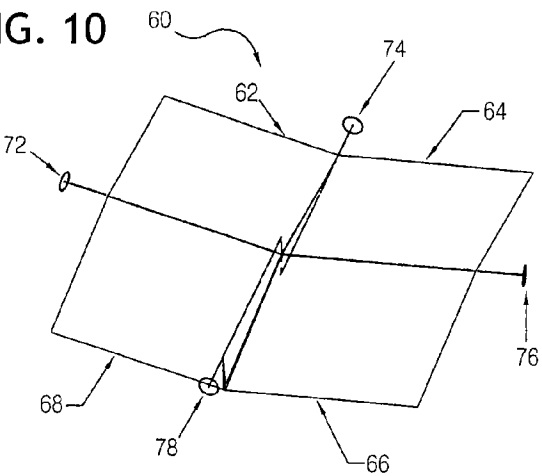
FIG. 10 is a perspective view of a second embodiment of the inventive link assembly.

FIG. 10 shows an assembly 60 which is comprised of four links 62, 64, 66 and 68 which are pivotally joined by axes 72, 74, 76 and 78 respectively. Links 62, 64, 66 and 68 are each comprised of two planes and each have two non-intersecting axes. Axes 74 and 78 lie in a common plane; likewise, axes 72 and 76 lie in a common plane.

Figure 11:
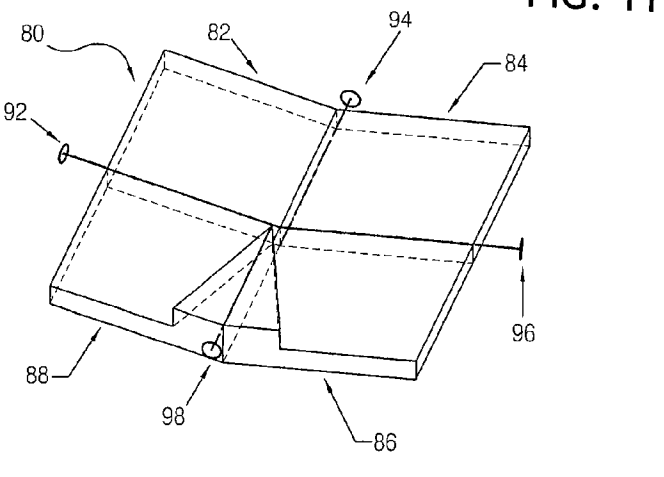
FIG. 11 is a perspective view of a third embodiment of the inventive link assembly.

FIG. 11 shows an assembly 80 which is comprised of four links 82, 84, 86 and 88 which are pivotally joined by axes 92, 94, 96 and 98 respectively. Links 82, 84, 86 and 88 are constructed as three dimensional volumes. The geometric relationship between axes 92, 94, 96 and 98 is identical to that shown between axes 72, 74, 76 and 78 as shown in FIG. 10.

Figure 12:
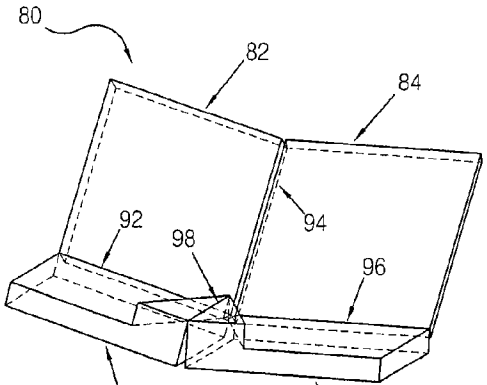
FIG. 12 is a perspective view of the assembly of FIG. 11 in a partially folded condition.
Figure 13:
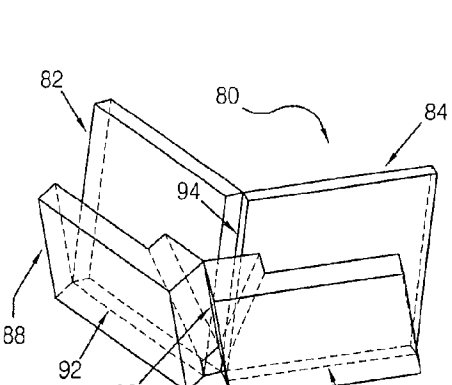
FIG. 13 is a perspective view of the assembly of FIG. 11 in a further folded condition.
Figure 14:
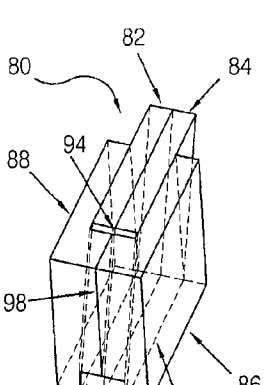
FIG. 14 is a perspective view of the assembly of FIG. 11 in a completely folded condition.

FIG. 12 shows assembly 80 in a partially folded position. FIG. 13 shows assembly 80 in a further folded position. FIG. 14 shows assembly 80 in a fully folded position where links 82, 84, 86 and 88 are stacked into a cubic bundle. The relationships of axes 92, 94, 96 and 98 with regards to whether they intersect is unchanged throughout the folding process.

Figure 15:
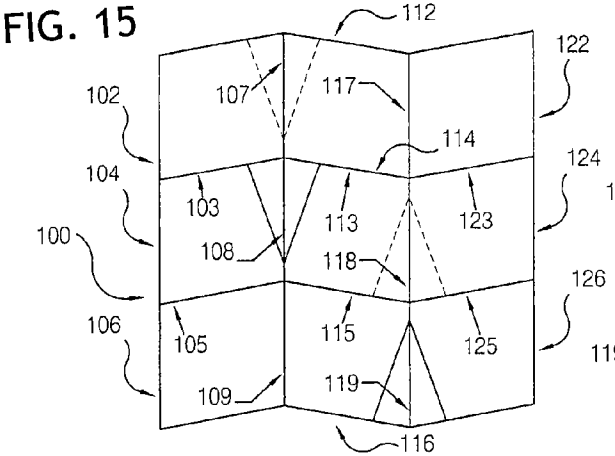
FIG. 15 is a perspective view of a fourth embodiment of the inventive link assembly.

FIG. 15 shows a plan view of assembly 100 which is comprised of nine links 102, 104, 106, 112, 114, 116, 122, 124 and 126 that are joined together in a three-by-three grid arrangement. Each link is pivotally attached to its neighbors by axes that lie in various different planes. For example, link 102 is joined to link 112 by axis 107. Likewise, link 114 is joined to link 116 by axis 115.

Figure 16:
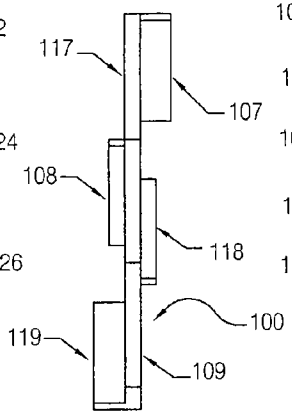
FIG. 16 is an elevational view of the link assembly of FIG. 15.

FIG. 16 shows an elevation view of assembly 100. Axes 107, 108, 109, 117, 118 and 119 are shown; all lie in different planes.

Figure 17:
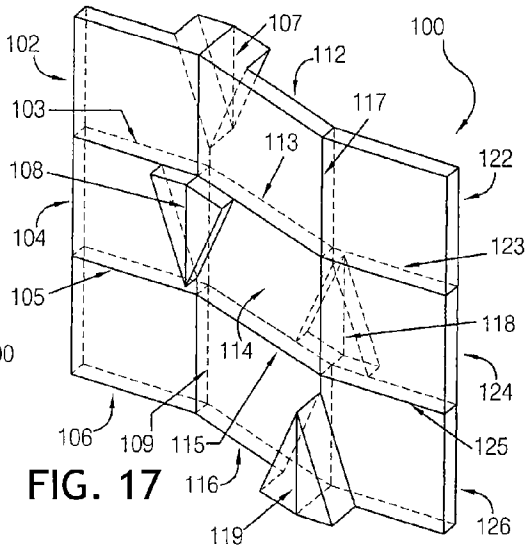
FIG. 17 is a perspective view of a fifth embodiment of the inventive link assembly.

FIG. 17 shows a perspective view of assembly 100. It may be seen that links 102, 104, 106, 112, 114, 116, 122, 124 and 126 form a common plane having significant thickness. Axes 103, 113 and 123 lie on one side of the common plane. Axes 105, 115 and 125 lie on the other side of the common plane. Axes 107, 108, 109, 117, 118 and 119 lie outside of the common plane.

Figure 18:
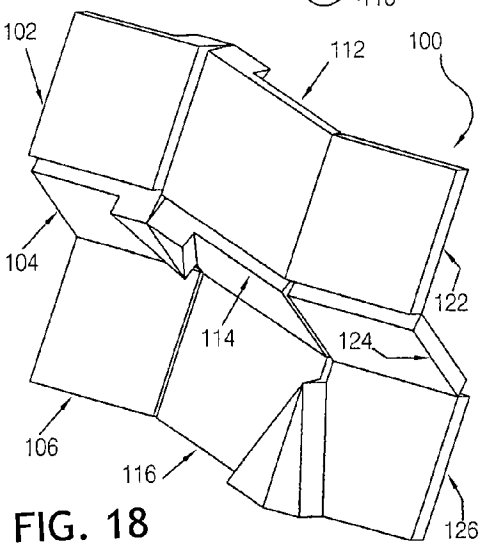
FIG. 18 is a perspective view of the link assembly of FIG. 17 in a partially folded condition.
Figure 19:
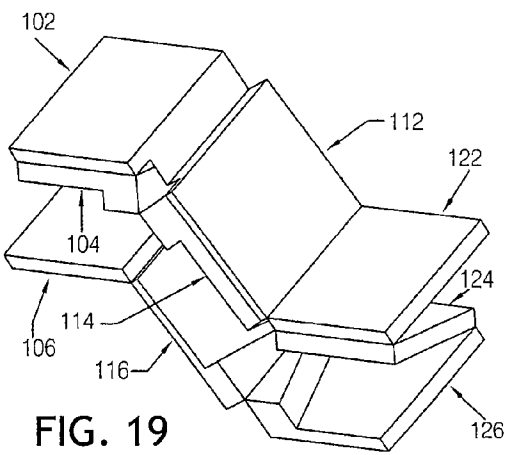
FIG. 19 is a perspective view of the link assembly of FIG. 17 in a further folded condition.

FIGS. 18 and 19 show perspective views of assembly 100 as it is successively folded.

Figure 20:
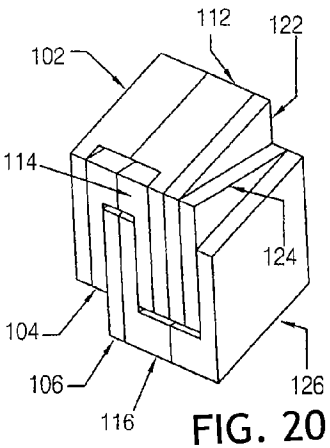
FIG. 20 is a perspective view of the link assembly of FIG. 17 in a completely folded condition.

FIG. 20 shows assembly 100 in a fully folded state such that links 102, 104, 106, 112, 114, 116, 122, 124 and 126 form a cubic bundle.

Figures 21, 22, 23, 24, 25, 26, 27:
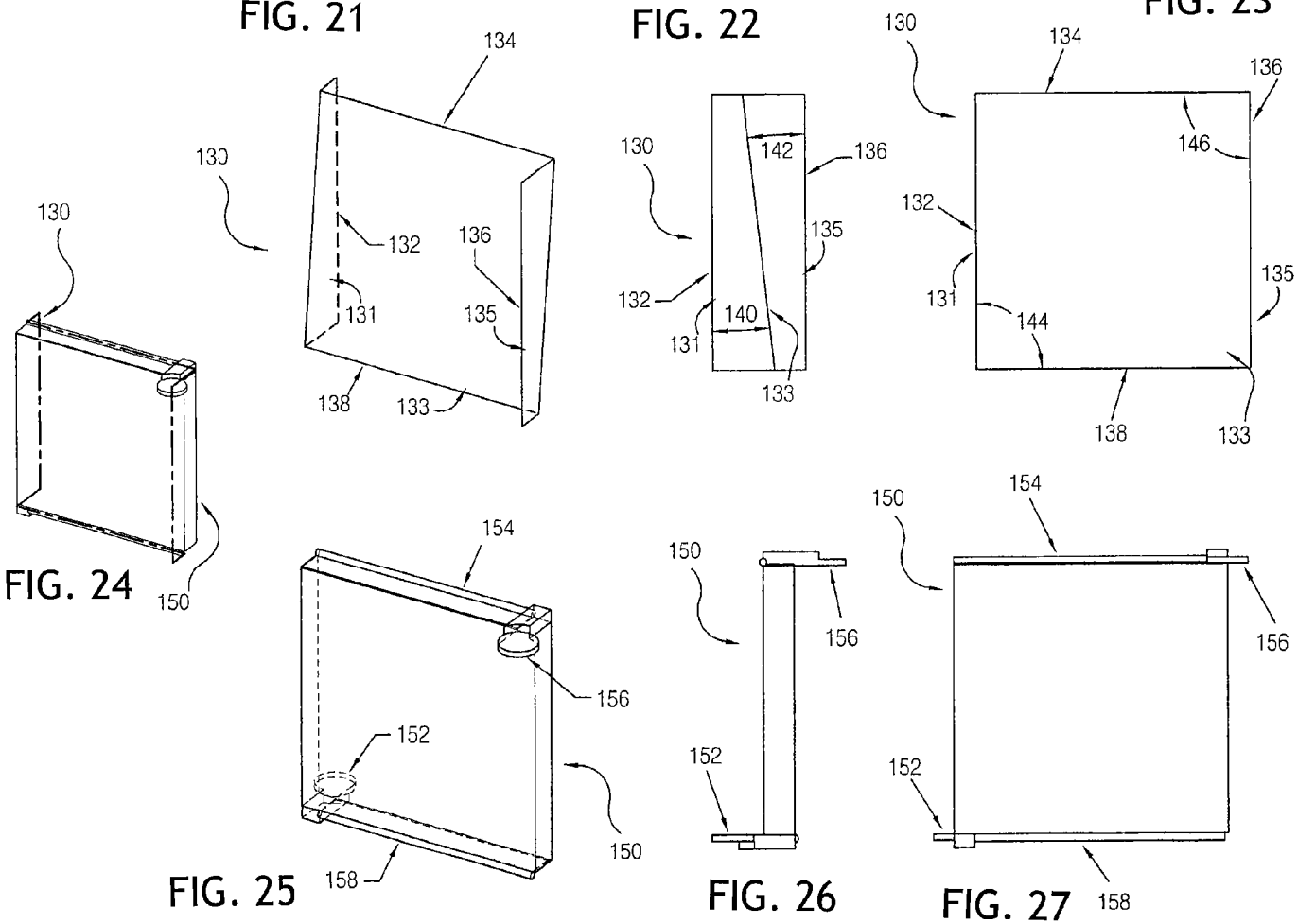
FIG. 21 is a perspective view of a second link used in the inventive assembly.
FIG. 22 is an elevational view of the link of FIG. 21.
FIG. 23 is a plan view of the link of FIG. 21.
FIG. 24 is a perspective view of a third link superimposed over the link of FIG. 21.
FIG. 25 is a detailed perspective view of the third link of FIG. 24.
FIG. 26 is an elevational view of the link of FIG. 25.
FIG. 27 is a plan view of the link of FIG. 25.

FIG. 21 shows a perspective view of link 130 that is comprised of three planes 131, 133 and 135. Also shown are four axes; axis 132 which borders plane 131, axis 136 which borders plane 135, and axes 138 and 134 which border plane 133. Axes 132, 134, 136 and 138 are non-intersecting.

FIG. 22 shows an elevation view of link 130. Axis 132 forms an angle 140 with plane 133. Likewise, axis 136 forms an angle 142 with plane 133.

FIG. 23 shows a plan view of link 130. It may be seen that link 130 has an essentially square shape. Axis 138 forms a right angle 144 with plane 131. Axis 136 forms a right angle 146 with plane 135.

FIG. 24 shows a link 150 which is superimposed over link 130 which is shown in dashed line. Link 150 is constructed as a three dimensional volume whereas link 130 is shown as constructed of three thin planes.

FIG. 25 shows link 150 in more detail. Link 150 has four axes 152, 154, 156 and 158. The geometric relationship between these non-intersecting axes is identical to axes 132, 134, 136 and 138 as shown in FIG. 21.

FIG. 26 shows an elevation view of link 150. FIG. 27 shows a plan view of link 150.

Figures 28, 29, 30, 31, 32, 33, 34:
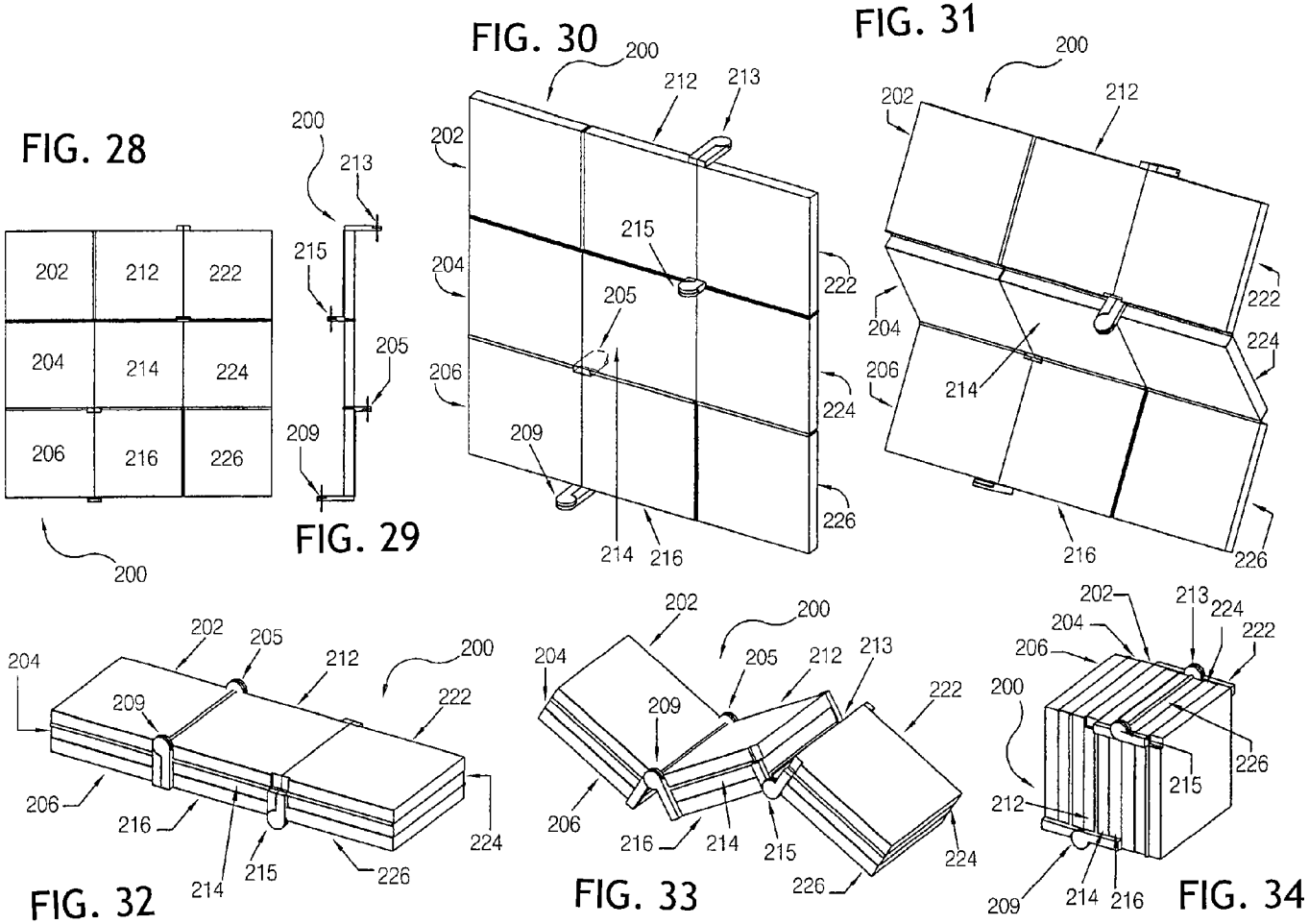
FIG. 28 is a plan view of a sixth embodiment of the inventive link assembly.
FIG. 29 is a side elevational view of the link assembly of FIG. 28.
FIG. 30 is a perspective view of the link assembly of FIG. 28 in an unfolded condition.
FIG. 31 is a perspective view of the link assembly of FIG. 28 in a partially folded condition.
FIG. 32 is a perspective view of the link assembly of FIG. 28 in a further folded condition.
FIG. 33 is a perspective view of the link assembly of FIG. 28 in yet a further folded condition.
FIG. 34 is a perspective view of the link assembly of FIG. 28 in a fully folded condition.

FIG. 28 shows an elevation view of assembly 200 which is comprised of nine links 202, 204, 206, 212, 214, 216, 222, 224 and 226. The links form a three-by-three grid of square shapes. They are each connected to their neighbors by various axes that lie in different planes.

FIG. 29 shows a second elevation view of assembly 200. Four axes 205, 209, 213 and 215 are shown in this view, all of which lie outside the main plane defined by assembly 200.

FIG. 30 shows a perspective view of assembly 200 in its unfolded state wherein it forms a flat plane.

FIG. 31 shows assembly 200 in a partially folded state. It may be seen that links 202, 212 and 222 continue to lie in a common plane. Links 204, 214 and 224 also lie in a common plane that forms an angle with the plane of the previous three links. Likewise, links 206, 216 and 226 lie in a common plane, also forming an angle with the previous two planes.

In FIG. 32 assembly 200 has be further folded such that the three common planes formed respectively by 202, 212, 222 and 204, 214, 224 and 206, 216, 226 are stacked one over the other.

FIG. 33 shows assembly 200 in a further folded position such that the stacked links 202, 204 and 206 form an angle with stacked links 212, 214 and 216 which in turn form an angle with stacked links 222, 224 and 226. It may be observed that axes 209 and 205 are co-axial relative to each other. Likewise, axes 213 and 215 are co-axial relative to each other.

FIG. 34 shows assembly 200 in a fully folded position such that the nine links 202, 204, 206, 212, 214, 216, 222, 224 and 226 are stacked one over the other. Thus, assembly 200 folds in a two-stage process with the first stage being illustrated by FIGS. 30-32, and the second stage being illustrated by FIGS. 32-34.

Figure 35:
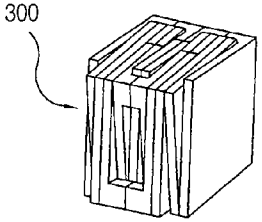
FIG. 35 is a perspective view of a seventh embodiment of the inventive link assembly in a folded condition.

FIG. 35 shows an assembly 300 which is in a fully folded position.

Figure 36:
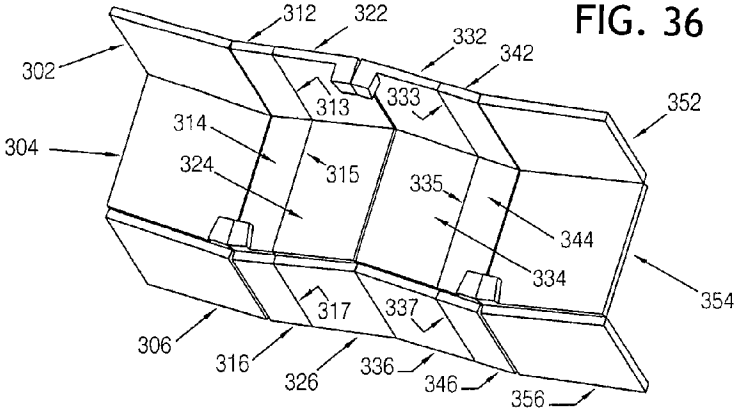
FIG. 36 is a perspective view of the link assembly of FIG. 35 in a partially folded condition.

FIG. 36 shows assembly 300 in a partially folded position. Assembly 300 is comprised of eighteen links arranged in three rows. The upper row is comprised of links 302, 312, 322, 332, 342 and 352. The middle row is comprised of links 304, 314, 324, 334, 344 and 354. The lower row is comprised of links 306, 316, 326, 336, 346 and 356. Link 312 is connected to link 322 by hinge 313. Links 312 and 322 are constrained to lie in a common plane because of the position of the assembly. Likewise, links 314 and 324 are constrained to lie in a common plane, and are connected each other by hinge 315. Similarly, links 316, 326 and 332, 342 and 334, 344 and 336, 346 are connected by hinges 317, 333, 335 and 337 respectively and are constrained to lie in common planes relative to one another.

Figure 37:
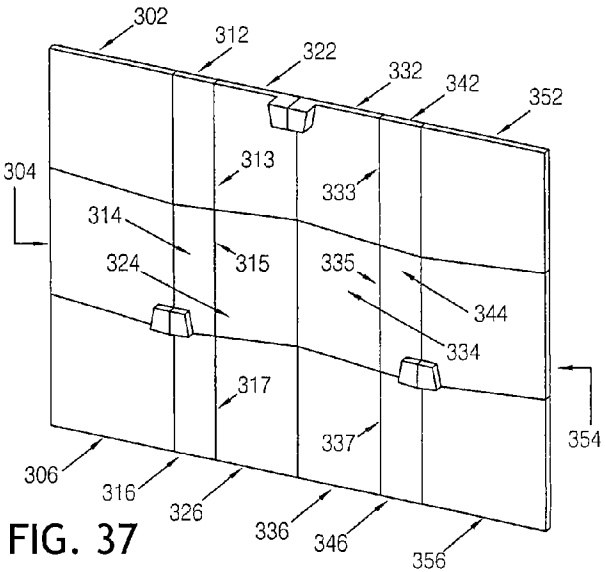
FIG. 37 is a perspective view of the link assembly of FIG. 35 in an unfolded condition.

FIG. 37 shows assembly 300 in an unfolded position wherein all the links form a common plane. Hinges 313, 315 and 317 share a common axis in this position. Likewise, hinges 333, 335 and 337 share a common axis in the unfolded position.

Figure 38:
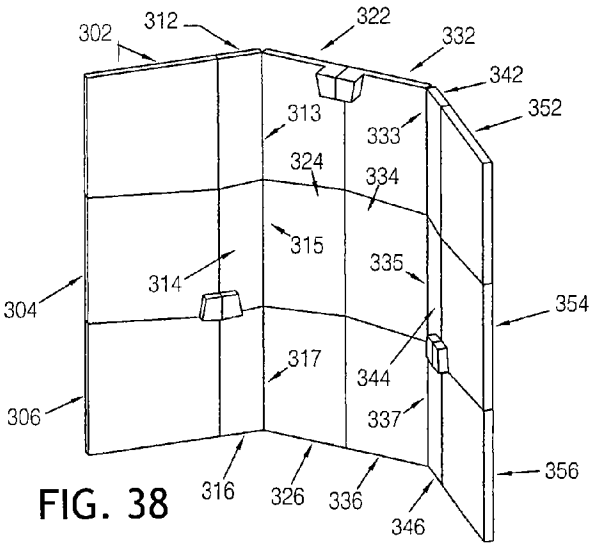
FIG. 38 is a perspective view of the link assembly of FIG. 35 in a second alternative unfolded condition.

FIG. 38 shows assembly 300 in a second alternative unfolded position where links 302, 304, 306, 312, 314 and 316 have been rotated along hinges 313, 315 and 317. Additionally, links 342, 344, 346, 352, 354 and 356 have been rotated along hinges 333, 335 and 337. In this way, assembly 300 becomes self-supporting and can be used as a divider or wall.

Figure 39:
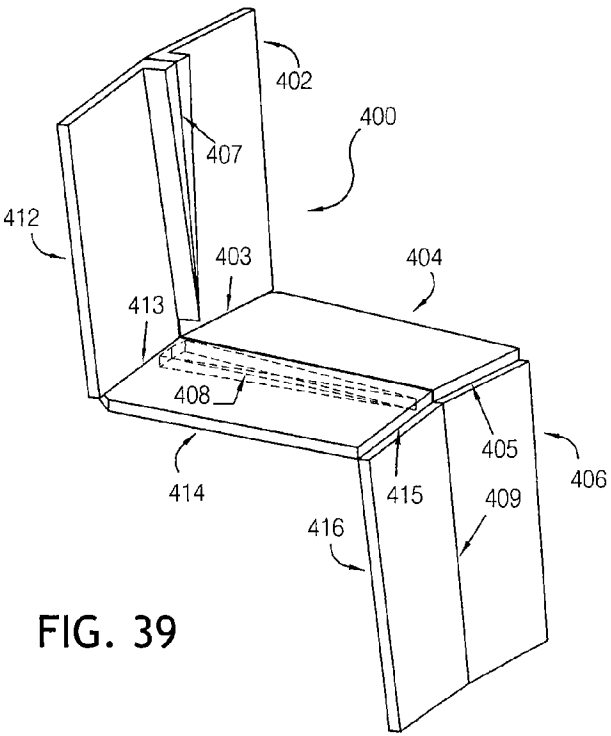
FIG. 39 is a perspective view of an eight embodiment of the inventive link assembly in a partially folded condition.

FIG. 39 shows an assembly 400 which is comprised of six links 402, 404, 406, 412, 414 and 416. Link 402 is attached to link 412 by hinge 407. Similarly, each link is attached to its neighboring links by hinges 403, 405, 408, 409, 413 and 415. Assembly 400 is shown in a partially folded configuration so that the approximate shape of a chair is formed.

Figure 40:
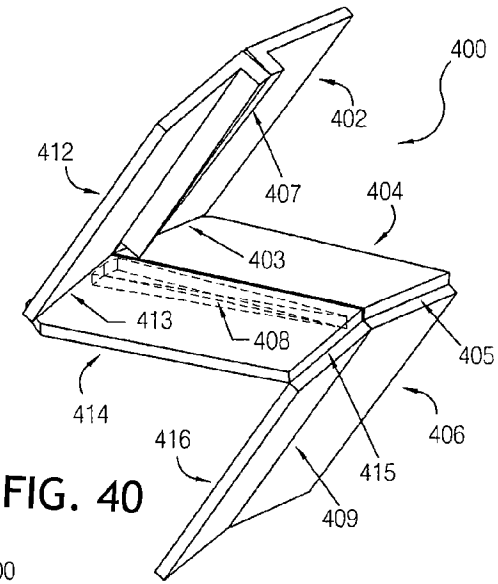
FIG. 40 is a perspective view of the link assembly of FIG. 39 in a further folded condition.
Figure 41:
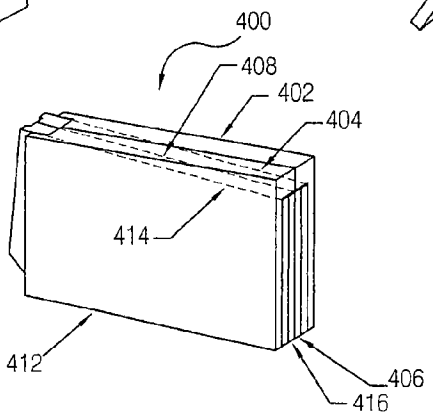
FIG. 41 is a perspective view of a perspective view of the link assembly of FIG. 39 in a completely folded condition.

FIG. 40 shows assembly 400 in a partially folded position. FIG. 41 shows assembly 400 in a fully folded position.

Figure 42:
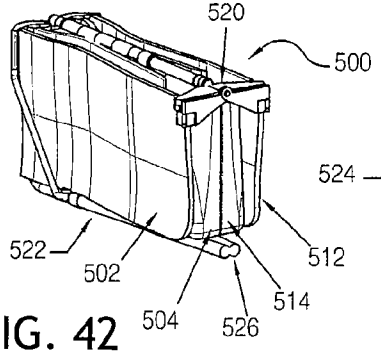
FIG. 42 is a perspective view of a ninth embodiment of a link assembly made in accordance with the invention.

FIG. 42 shows an assembly 500 that is in a fully folded position and is comprised of four links 502, 504, 512 and 514 which are essentially stacked one over the other. In addition to these four links, there are frame elements 522 and 526. Also shown in FIG. 42 is hinge 520 which attaches links 502 and 512.

Figure 43:
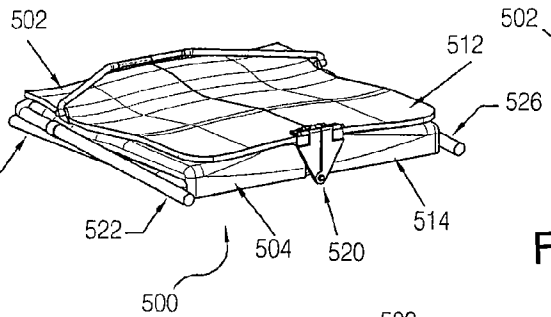
FIG. 43 is a perspective view of the link assembly of FIG. 42 in a partially unfolded condition.

In FIG. 43, assembly 500 is shown in a partially unfolded position such that links 504 and 512 lie along side of one another. Links 502 and 512 also lie along side each other in this position.

Figure 44:
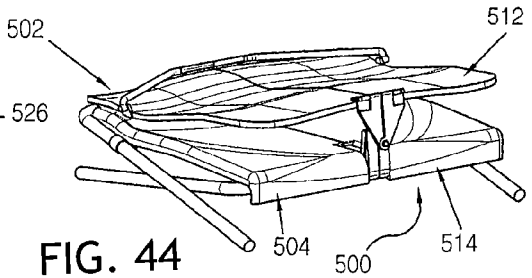
FIG. 44 is a perspective view of the link assembly of FIG. 42 in a further unfolded condition.
Figure 45:
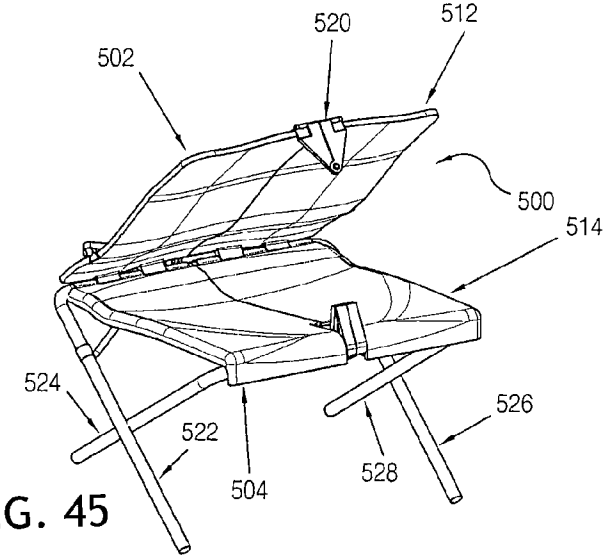
FIG. 45 is a perspective view of the link assembly of FIG. 42 in a still further unfolded condition.

FIGS. 44 and 45 show assembly 500 in positions that are successively further unfolded. Frame elements 522, 524, 526 and 528 are seen to extend as links 502, 504, 512 and 514 are unfolded.

Figure 46:
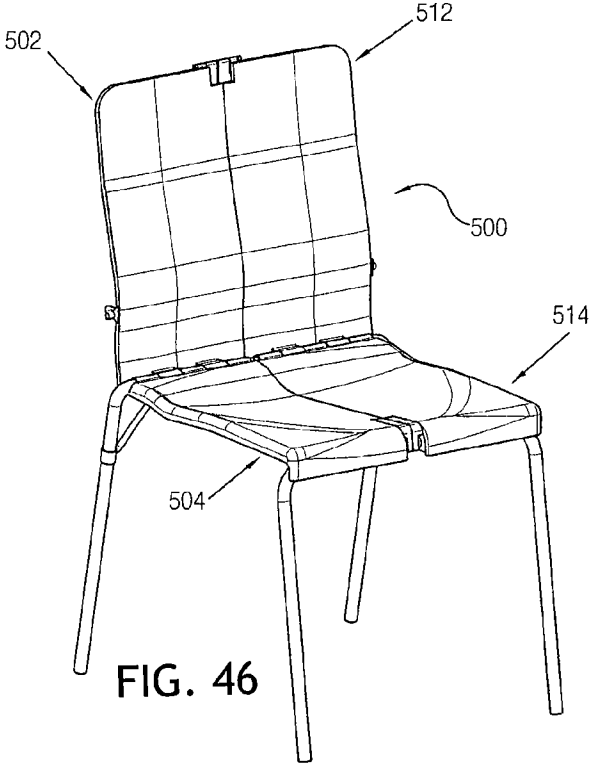
FIG. 46 is a perspective view of the link assembly of FIG. 42 in a fully unfolded condition.

FIG. 46 shows assembly 500 in a fully unfolded position forming a stable and self-supporting chair.

Figure 47:
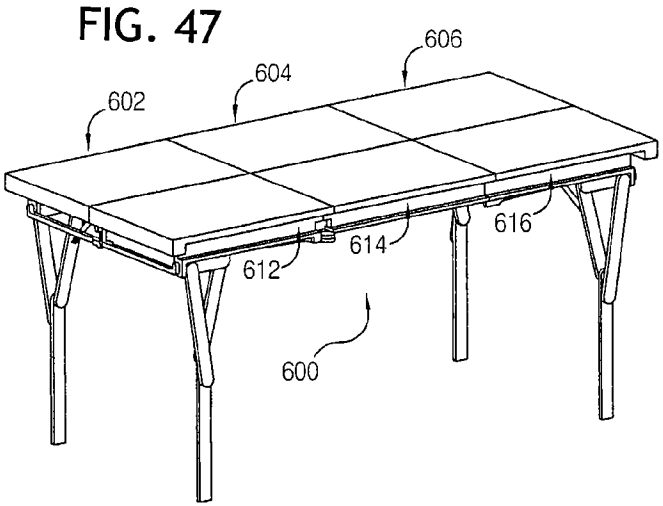
FIG. 47 is a perspective view of a tenth embodiment of the inventive link assembly.

FIG. 47 shows an assembly 600 that is comprised of six links 602, 604, 606, 612, 614 and 616 that form the surface of a table.

Figure 48:
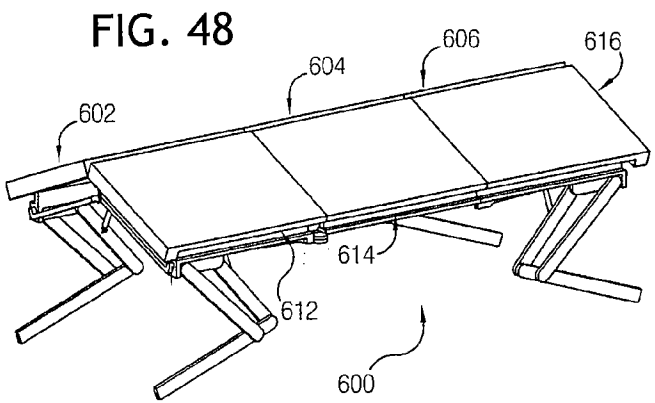
FIG. 48 is a perspective view of the embodiment of FIG. 47 in a first folded condition.
Figure 49:
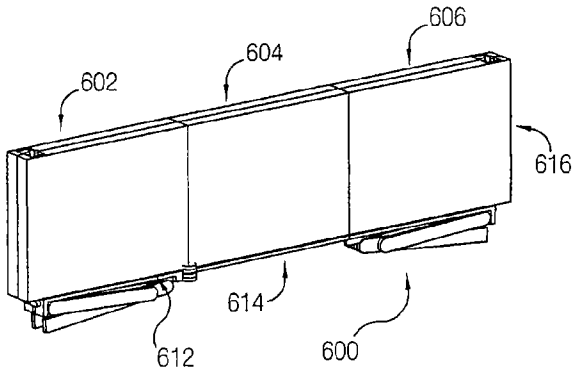
FIG. 49 is a perspective view of the embodiment of FIG. 47 in a second folded condition.
Figure 50:
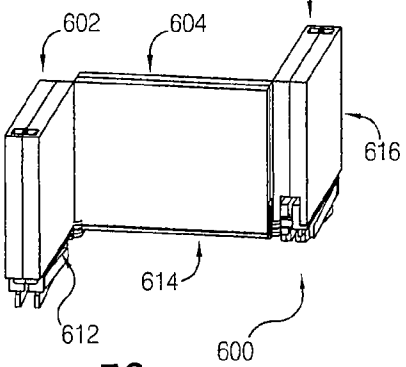
FIG. 50 is a perspective view of the embodiment of FIG. 47 in a third folded condition.

FIGS. 48-50 show assembly 600 as it appears in successively further folded positions.

Figure 51:
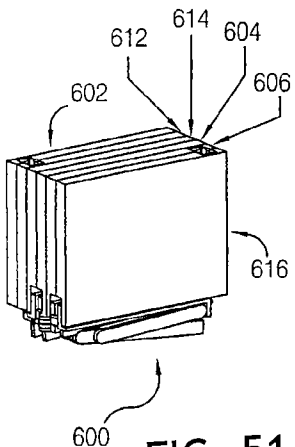
FIG. 51 is a perspective view of the embodiment of FIG. 47 in a fully folded condition.

FIG. 51 shows assembly 600 in a fully folded position forming a compact cubic bundle.

The scope of the invention will now be set forth in the following claims.

The invention claimed is:

1. A link assembly comprising:

four links, each said link having a first linear edge for defining a first axis and a second linear edge for defining a second axis, said edges being disposed adjacent to each other;

wherein said first and second axes do not intersect one another;

wherein each link is pivotally connected to two other links with the first edge that defines the first axis of one of said links being foldably hinged to the first edge that defines the first axis of one connected link in order to provide a first fold line running along said first axis and the second edge that defines the second axis of said one of said links being foldably hinged to the second edge that defines the second axis of the other connected link in order to provide a second fold line running along said second axis;

wherein said first and second fold lines do not intersect one another and are on different planes; and wherein said link assembly is transformable from a fully unfolded condition to a fully folded condition.

2. The assembly of claim 1, wherein each link is constructed from a sheet of material and wherein the first and second axes of each said link lie in different planes that are parallel to the plane of the sheet.

3. The assembly of claim 1, wherein the links are in a stacked arrangement when the assembly is in a fully folded condition.

4. The assembly of claim 1, wherein the links define a planar element when the assembly is in a fully unfolded condition.

5. The assembly of claim 1, wherein each said link comprises two hinged polygonal planar portions, said first linear edge defined along one said planar portion and said second linear edge defined along the other said planar portion.

6. The link assembly of claim 1, wherein each said link further includes a third linear edge defining a third axis and a fourth linear edge defining a fourth axis, and wherein the first, second, third and fourth axes do not intersect.

7. The assembly of claim 6, wherein said link comprises three hinged polygonal planar portions, said first linear edge defined along one planar portion, said second linear edge defined along said second planar portion and said third and fourth linear edges defined along said third planar portion.

8. The assembly of claim 1, wherein said first axis of each said link lies in a first common plane and said second axis of each said link lies in a second, different common plane.

9. The assembly of claim 1, wherein each said link is constructed as a three dimensional volume.

10. The assembly of claim 1, wherein said links are joined together in a grid arrangement.

11. The assembly of claim 10, wherein said links are nine in number and are joined together in a three-by-three grid arrangement.

12. The assembly of claim 1, wherein said links are rectangular in shape.

13. The assembly of claim 12, wherein said links are square in shape.

14. The assembly of claim 13, wherein said links define a grid arrangement.

15. The assembly of claim 1, wherein said links are arranged in rows.

16. A folding chair comprised at least in part of the assembly according to claim 1.

17. A folding chair according to claim 16, wherein additional frame elements are attached thereto that fold with said assembly.

18. A folding table comprised at least in part of the assembly according to claim 1.

19. A folding table according to claim 18, wherein additional frame elements are attached thereto that fold with said assembly.

20. The assembly according to claim 1, further including secondary hinge portions such that the link assembly may, after being fully extended, be folded along such secondary hinge portions in order to be self-supporting.

* * * * *